US005451995A

United States Patent [19]

Swanson et al.

[11] Patent Number: 5,451,995

[45] Date of Patent: Sep. 19, 1995

[54] RIGID LOOP CASE STRUCTURE FOR THERMAL INK-JET PEN

[75] Inventors: David W. Swanson; James L. Ruder, both of Escondido; Timothy J. Carlin, San Diego, all of Calif.

[73] Assignee: Hewlett-Packard Company, Palo Alto, Calif.

[21] Appl. No.: 994,808

[22] Filed: Dec. 22, 1992

[51] Int. Cl.[6] ..... B41J 2/175

[52] U.S. Cl. ..... 347/87; 220/611

[58] Field of Search ..... 346/140 R, 75; 220/4.01, 4.12, 611, 613; B41J 2/175; B65D 6/00, 6/24; 347/87, 86

[56] References Cited

U.S. PATENT DOCUMENTS 3,913,774 10/1975 Vajtay ..... 220/4.01
4,571,599 2/1986 Rezanka ..... 346/140 R
4,931,811 6/1990 Cowger et al. ..... 346/140 R

FOREIGN PATENT DOCUMENTS 62-019460 1/1987 Japan ..... B41J 2/175

*Primary Examiner*—Benjamin R. Fuller
*Assistant Examiner*—Alrick Bobb

[57] ABSTRACT

A rigid external case structure for a thermal ink-jet pen cartridge, which includes an ink reservoir within the case. The case includes an external frame structure made of an engineering plastic, and defining an open loop, with opposed open areas defined on each opposed side of the loop. Two opposed thin metal side cover plates are attached to the frame structure to cover the open areas, and provide rigidity to the case structure. As a result, the frame structure is substantially non-compressible in response to forces applied against the side members or against the frame, protecting the ink reservoir and preventing ink drool from the pen printhead.

19 Claims, 6 Drawing Sheets

FIG. 2
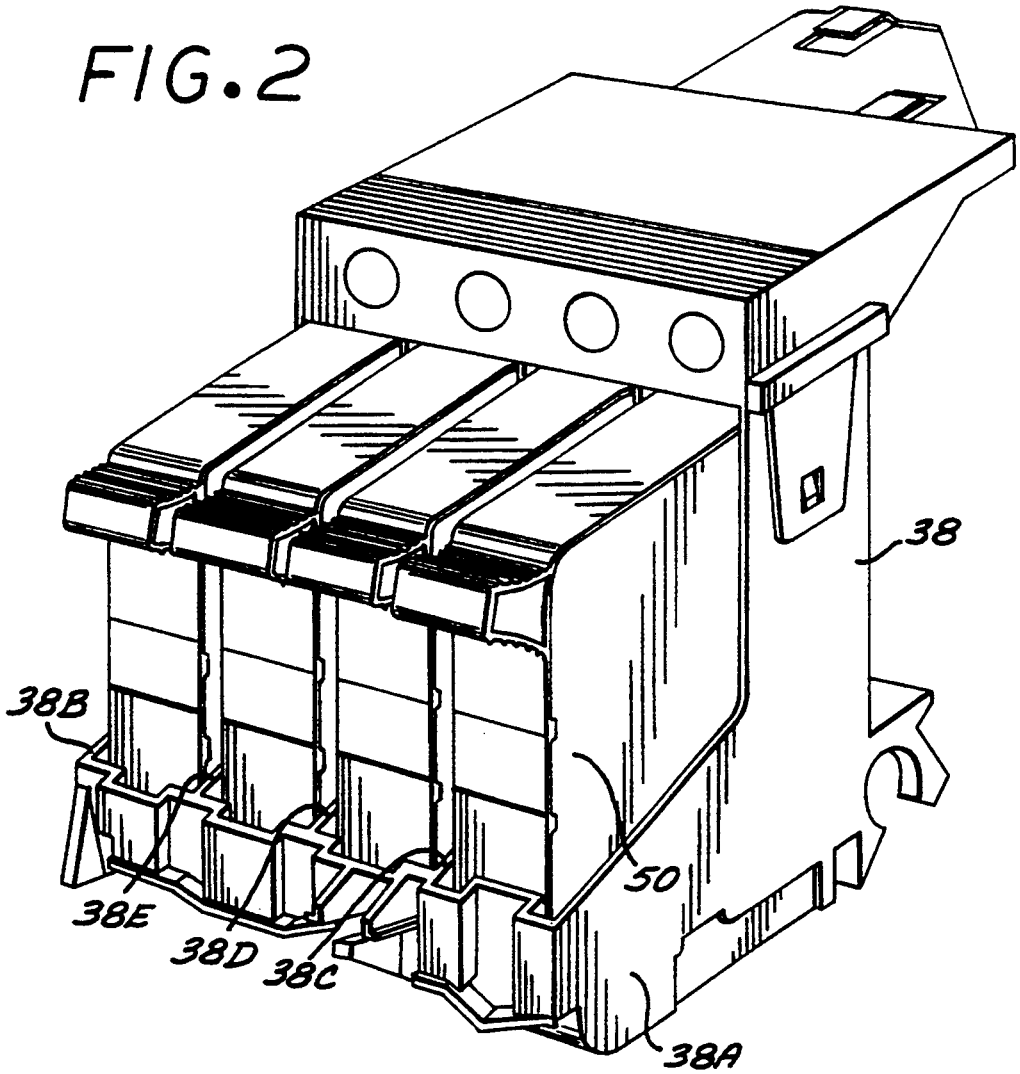
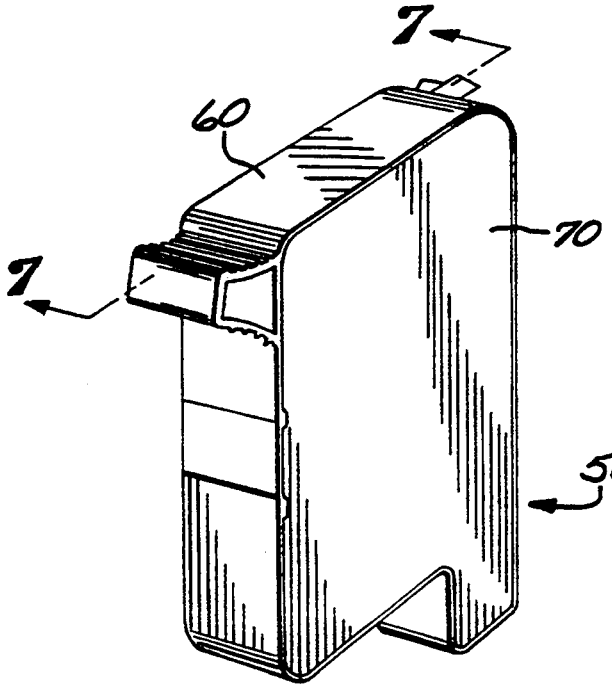
FIG. 3

FIG. 6A
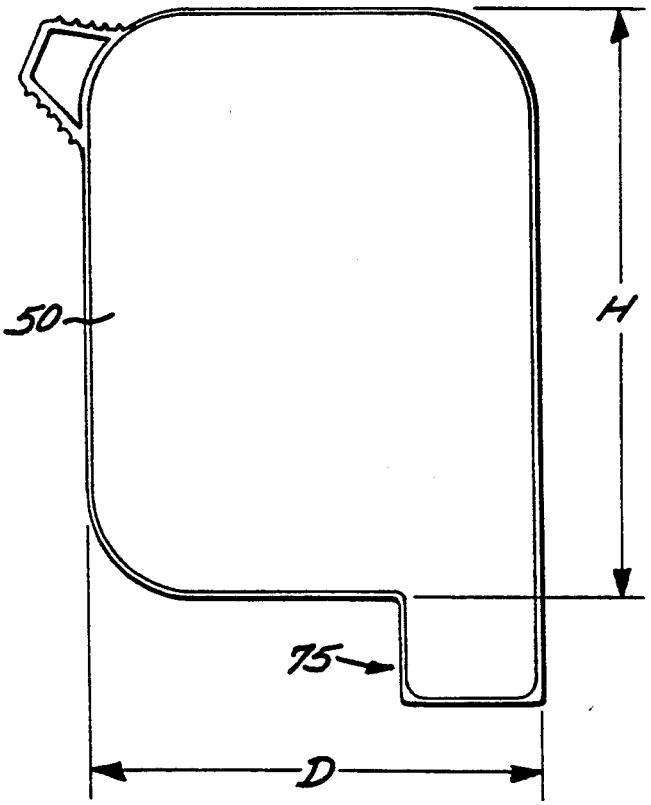
FIG. 6B
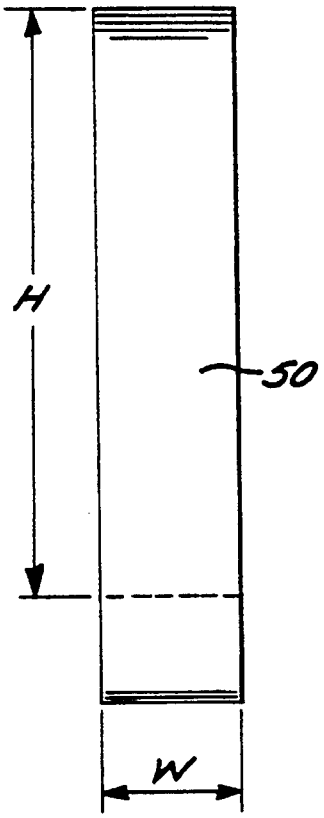
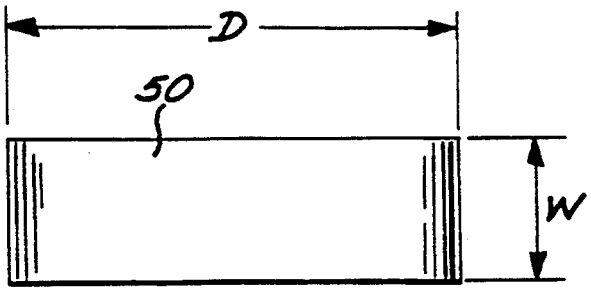
FIG. 6C

FIG. 7
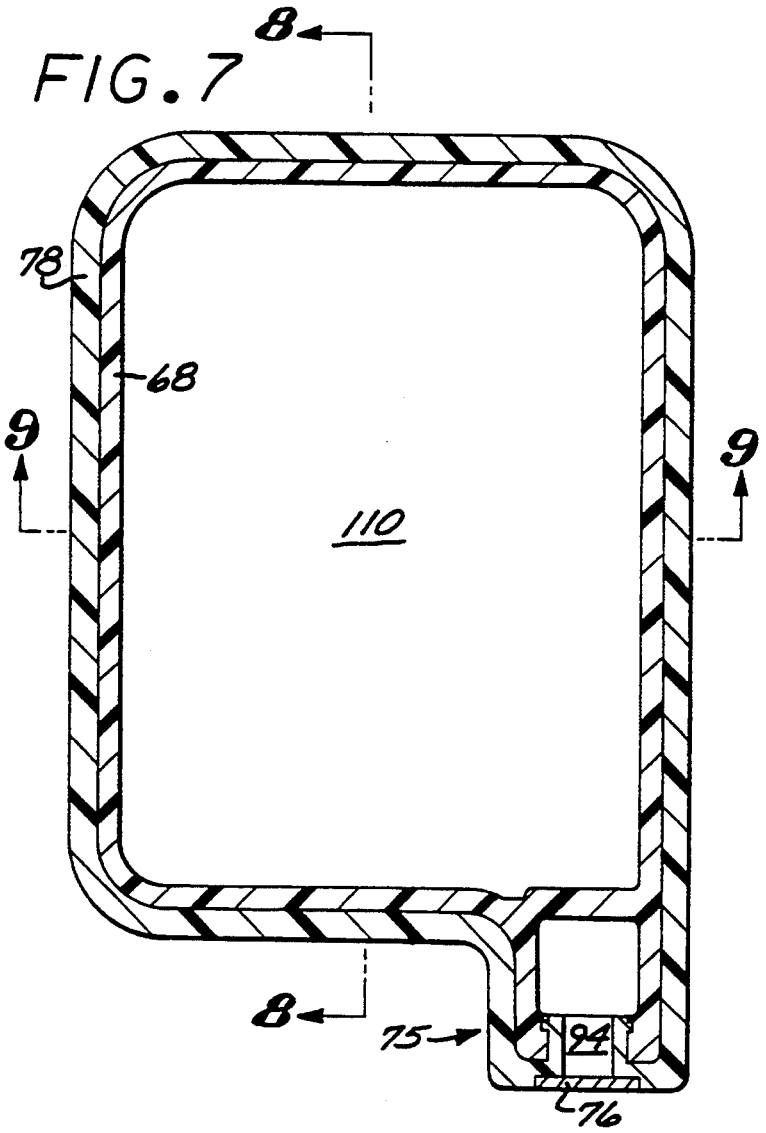
FIG. 8
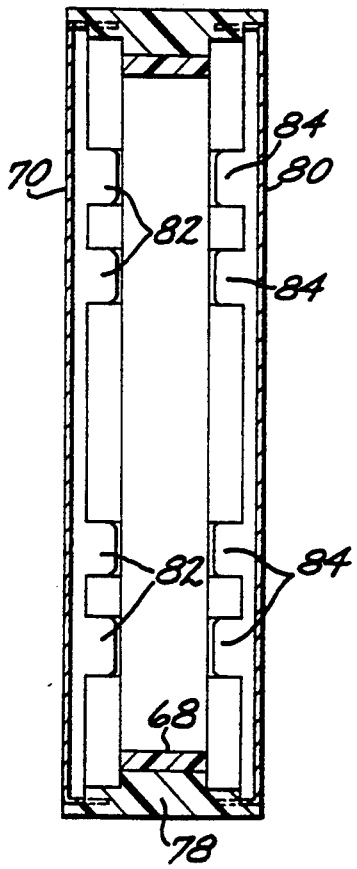
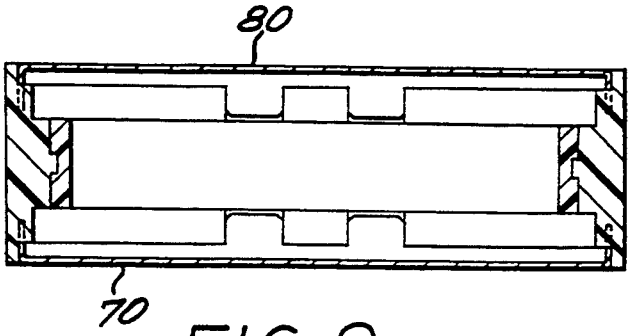
FIG. 9

FIG. 10
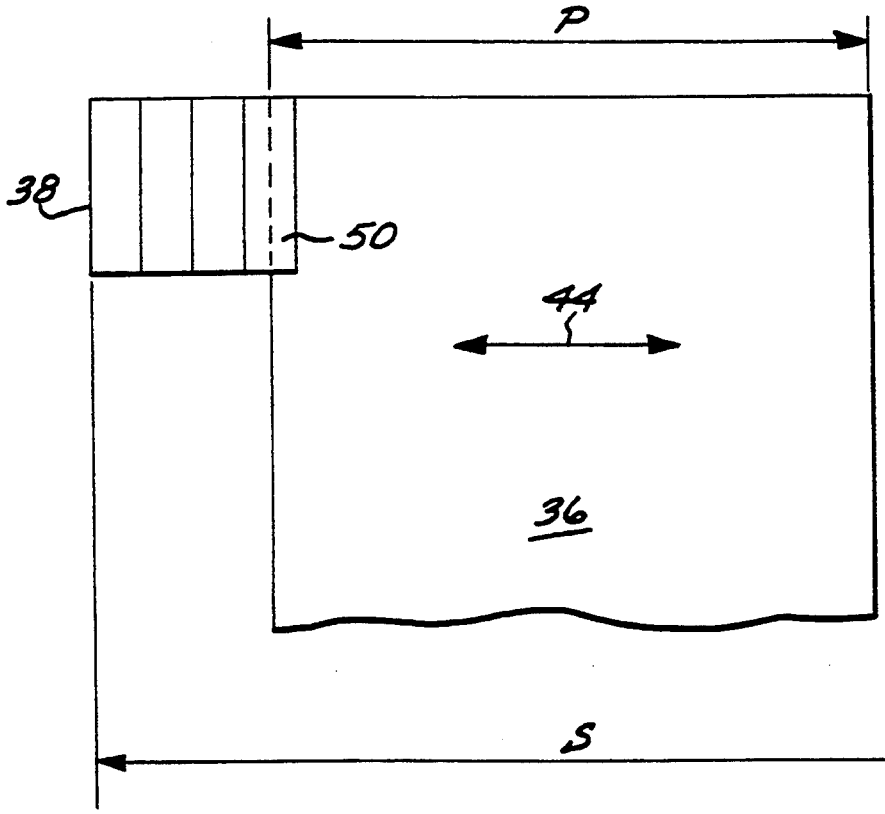
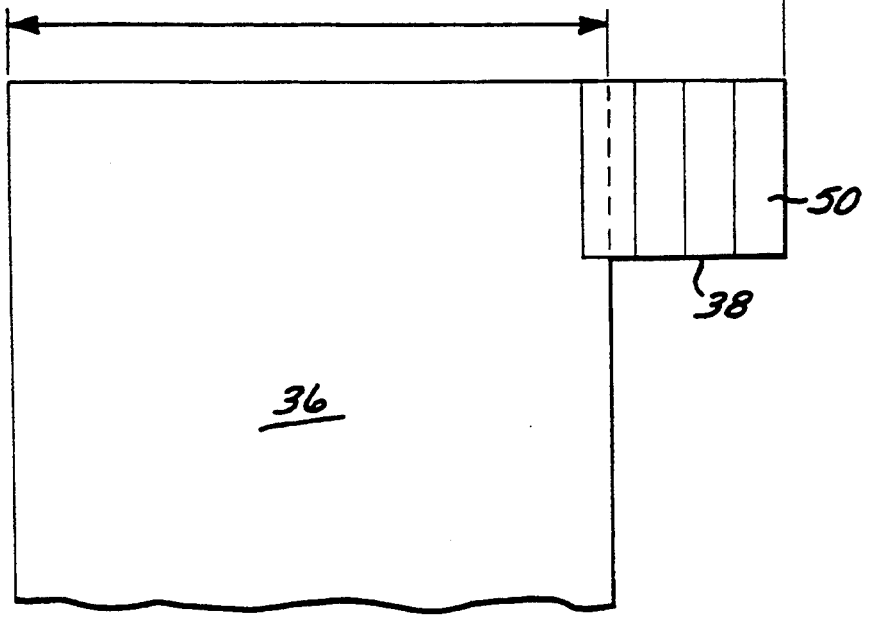
FIG. 11

RIGID LOOP CASE STRUCTURE FOR THERMAL INK-JET PEN

BACKGROUND OF THE INVENTION

The present invention is related to the following commonly assigned pending U.S. patent applications: COMPACT FLUID COUPLER FOR THERMAL INK JET PRINT CARTRIDGE INK RESERVOIR, Ser. No. 07/853,372, filed Mar. 18, 1992, by James G. Salter et al.; INK PRESSURE REGULATOR FOR A THERMAL INK-JET PRINTER, Ser. No. 07/928,811, filed Aug. 12, 1992, by Tofigh Khodapanah et al.; COLLAPSIBLE INK RESERVOIR STRUCTURE AND PRINTER INK CARTRIDGE, Ser. No. 07/929,615, filed Aug. 12, 1992, by George T. Kaplinsky et al.; TWO MATERIAL FRAME HAVING DISSIMILAR PROPERTIES FOR A THERMAL INK-JET CARTRIDGE, by David S. Swanson et al., Ser. No. 07/994,807, filed Dec. 22, 1992; COMBINED FILTER/AIR CHECK VALVE FOR THERMAL INK-JET PEN, by George T. Kaplinsky, Ser. No. 07/995,109, filed Dec. 22, 1992; DOUBLE COMPARTMENT INK-JET CARTRIDGE WITH OPTIMUM SNOUT, by David W. Swanson et al., Ser. No. 07/995,221, filed Dec. 22, 1992; THERMAL INK-JET PEN WITH A PLASTIC/METAL ATTACHMENT FOR THE COVER, by Dale D. Timm, Jr. et al., Ser. No. 07/994,810, filed Dec. 22, 1992; NEGATIVE PRESSURE INK DELIVERY SYSTEM, George T. Kaplinsky et al., Ser. No. 07/995,851, filed Dec. 23, 1992; THIN PEN STRUCTURE FOR THERMAL INK-JET PRINTER, by David W. Swanson et al., Ser. No. 07/994,808, filed Dec. 22, 1992; SPRING-BAG PRINTER INK CARTRIDGE WITH VOLUME INDICATOR, David S. Hunt et al., application Ser. No. 07/717,735, filed Jun. 19, 1991; U.S. Pat. No. 5,359,353, and SIDE BIASED PEN DATUM SCHEME FOR THERMAL INK-JET CARTRIDGE, by David S. Swanson et al., Ser. No. 08/057,241, filed Apr. 30, 1993; the entire disclosures of which are incorporated herein by this reference.

The present invention relates to thermal ink-jet (TIJ") pens characterized by a high volumetric efficiency in a thin pen package.

In any office product the overall size of the product has an effect on the cost and sell appeal of the product. In the thermal ink-jet printer market, the foot print of a personal printer is a key selling point if the printer can be made small enough to fit on a customer's desk top. In previous printers marketed by the assignee of the present invention, Hewlett-Packard Company ("HP"), such as the Paintjet XL and the Paintjet XL300, the printers are relatively large and typically are placed on a side table off the customer's desk due to their size. The HP Deskjet has a small footprint and is commonly placed on the customer's desk. The HP Deskjet is a single pen device and therefore the footprint is kept small. It is a goal of the present invention to permit a four pen color printer to have a footprint similar to such prior single pen printers.

When a thermal ink-jet product prints onto a page, the pen carriage must travel across the page such that every nozzle of every pen has an opportunity to reach the full paper area. In ink-jet devices, the paper is generally driven along one axis of motion and the pen is driven along a pen scan axis extending 90 degrees to the paper drive axis. This invention addresses shortening the travel along the pen scan axis.

For a single pen product, such as the HP Deskjet, the pen axis must travel the width of the paper plus the width of the pen head. For a four pen product, the pen axis must travel the width of the paper, plus the width of the four pens plus the space between the pens required to mount them. In this case the minimum product width is the paper width plus about twice the width of the pen carriage. The paper width is fixed (unless it is driven relative to the pens by a third axis of motion). In previous foam based pens, the pen width was about 1.25 inches and the pen mounts require about 0.2 inches per pen. In a four pen product this added up to a carriage width of 6 inches. This invention allows pens with the same amount of ink delivered to be narrow, e.g., 0.5 inches, and deliver the same ink volume with a carriage width of about 2.8 inches. This amounts to a reduction in the required product width of at least 6.4 inches, in this example.

As the product width is reduced, the volume of material required for fabrication and the size of plastic parts go down, reducing the molding machine size and thus the molding cost. The pen carriage is supported by beams that must span the length of travel. As the length of travel increase, the stiffness requirements of those beams cause their cross-sections, and thus their cost, to also increase. Thus any decrease in the spanned length is a cost benefit.

SUMMARY OF THE INVENTION

In accordance with the invention, a rigid external pen case structure is provided for a thermal ink-jet pen including an ink reservoir and a printhead. The ink reservoir is disposed within the case structure in fluid communication with the printhead. The case structure includes an external pen frame structure fabricated of a first material characterized by a first strength modulus value. The external frame structure defines a closed frame loop and first and second side open regions on either side of the loop. The case further includes first and second thin cover members fabricated of a second material characterized by a second strength modulus value. The second value is higher than the first value. The cover members are attached to the frame structure for covering the open regions, and rigidify the case structure so as to be substantially non-compressible in response to forces exerted against the side members or against said frame structure.

In the preferred embodiment, the first material is an engineering plastic, and the second material of the covers is a mild steel. The cover members are attached to the frame structure at points along all sides of the frame structure, and no support structure extends across the open regions to provide support to the covers. As a result, the case structure has a high volumetric efficiency.

BRIEF DESCRIPTION OF THE DRAWING

These and other features and advantages of the present invention will become more apparent from the following detailed description of an exemplary embodiment thereof, as illustrated in the accompanying drawings, in which:

FIG. 2 is an isometric view of the pen carriage of the printer of FIG. 1.

FIG. 3 is an isometric view of a printer pen in accordance with this invention.

FIGS. 6A–6C show side, front, and top plan views of the pen of claim 3.

FIG. 7 is a cross-sectional view taken along line 7—7 of FIG. 3.

FIG. 8 is a cross-sectional view taken along line 8—8 of FIG. 7.

FIG. 9 is a cross-sectional view taken along line 9—9 of FIG. 7.

FIGS. 10 and 11 illustrate the positioning of the print carriage at opposing sides of the print media.

DETAILED DESCRIPTION OF THE PREFERRED EMBODIMENT

Figure 1:
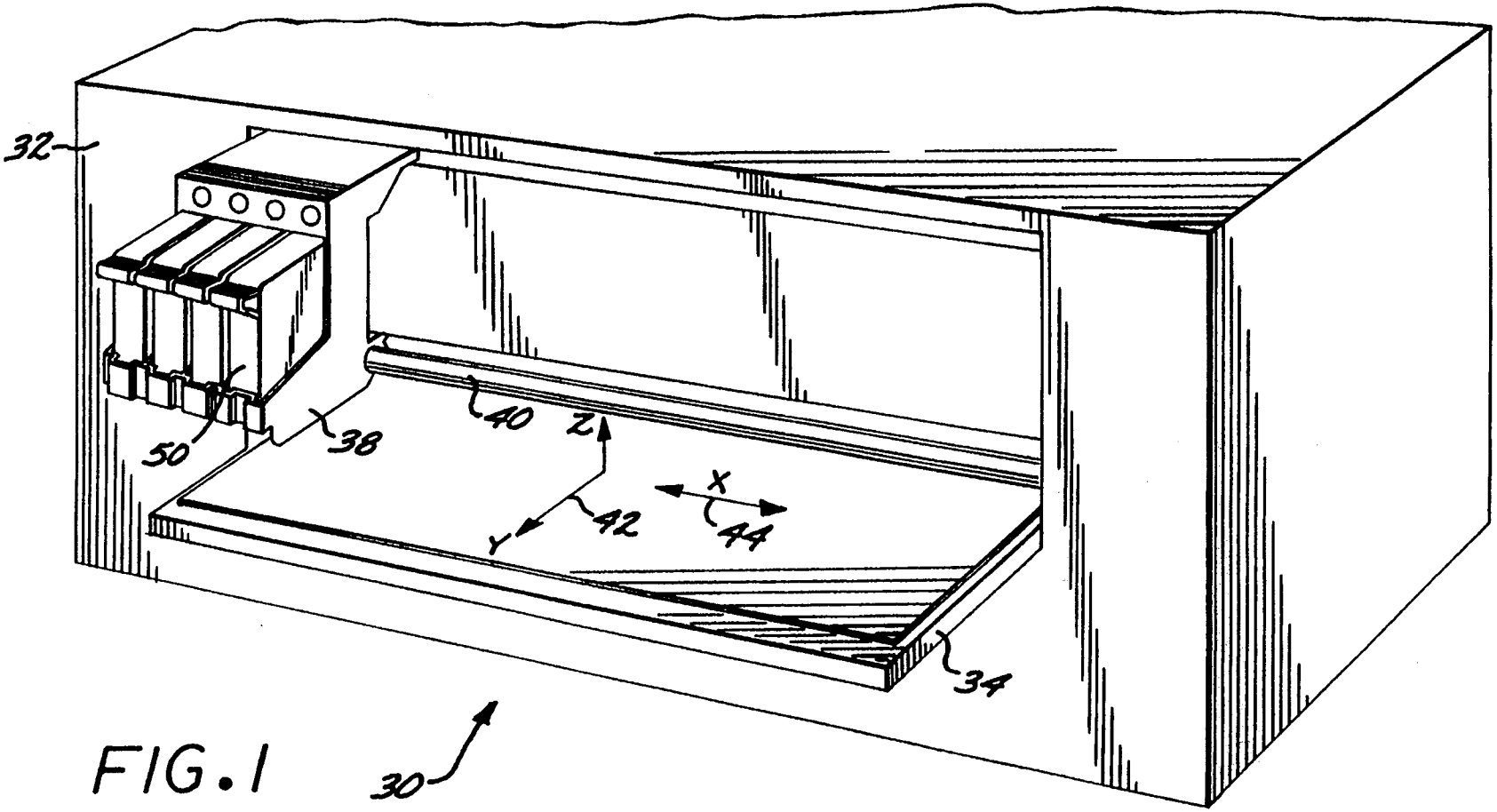
FIG. 1 is an isometric view of a printer device embodying this invention.

FIG. 1 illustrates a TIJ printer 30 embodying the present invention. The printer includes a housing 32 which supports various elements including the platen 34 which supports the print medium 36 such as a sheet of paper. The printer includes a pen carriage 38 which is driven along the support shaft 40 to eject drops of ink from the pens 50 onto the print medium. As is well known in the art, the printer further includes media advancement mechanisms not shown in FIG. 1 to advance the medium in the Y direction of arrow 42 along the medium advancement axis to position the medium for the next successive transverse swath carried out by the carriage 38 along the scan axis 44. According to one aspect of the invention, the carriage 38 holds a plurality of thin pens 46, and is relatively narrow due to the thinness of the pens along the X direction 44 of carriage movement. As a result, the required width of the printer 30 can also be relatively smaller than in prior designs. Further, the depth dimension of the pen is smaller than the height dimension, thereby minimizing the pen footprint while providing a high volume pen. This permits further a reduction in the printer footprint size.

In the preferred embodiment, the carriage 38 is adapted to carry four pens 50, each of a different color, for example, black, cyan, magenta and yellow. The pens 50 are secured in a closely packed arrangement, and may be selectively removed from the carriage for replacement with a fresh pen. The carriage 38 includes a pair of opposed side walls 38A and 38B, and spaced short interior walls 38C–E, which define pen compartments (FIG. 2). The carriage walls are fabricated of a rigid engineering plastic, and are thin; in this embodiment the carriage walls have a thickness of about 0.08 inches (2 millimeters). The printheads of the pens 50 are exposed through openings in the pen compartments facing the print medium.

Figure 4:
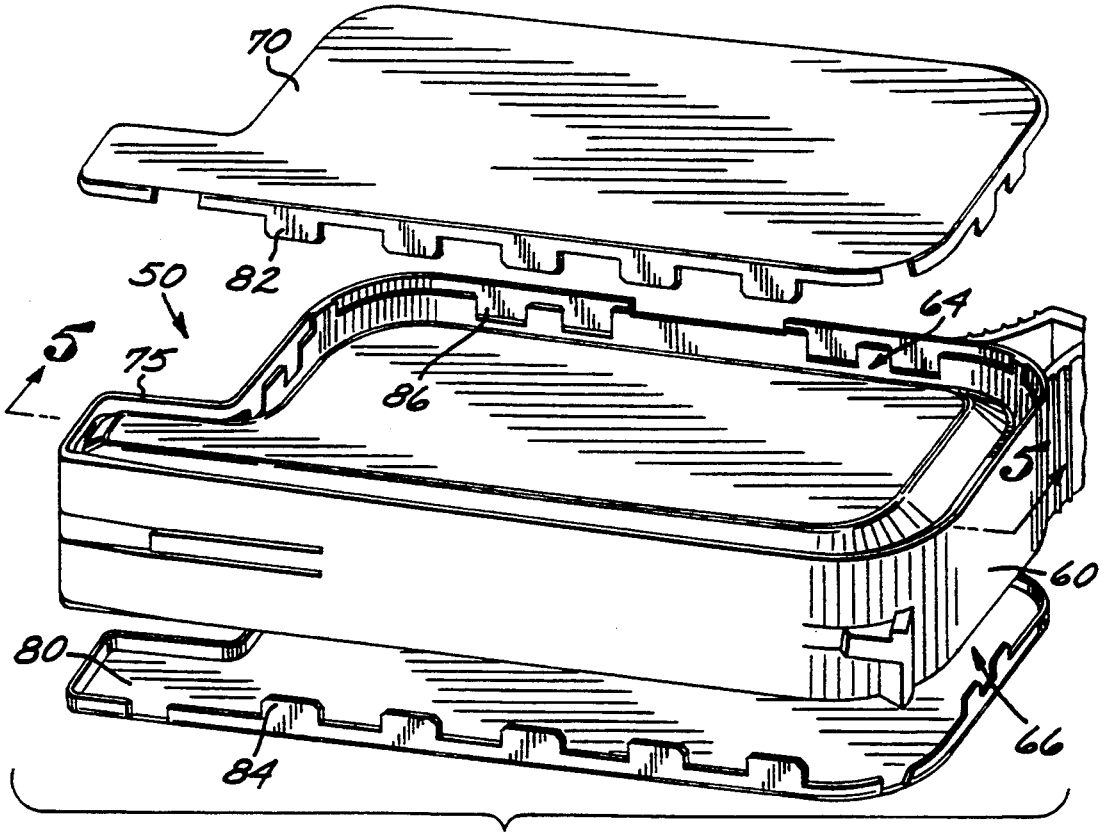
FIG. 4 is an exploded isometric view of the pen of FIG. 3.
Figure 5:
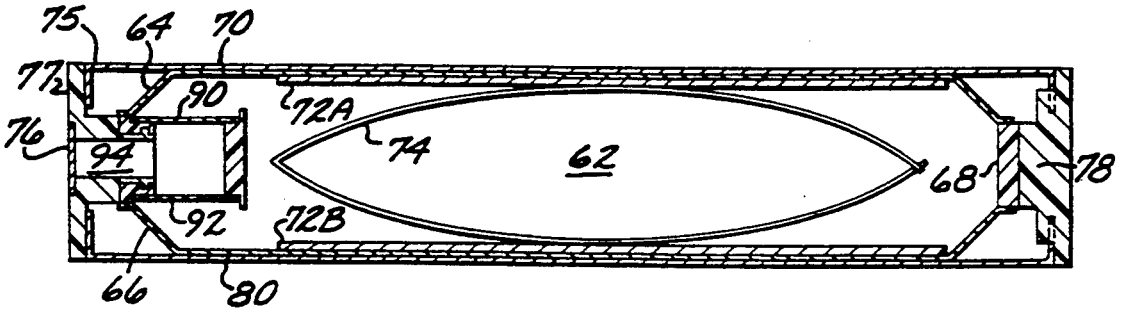
FIG. 5 is a cross-sectional view taken along line 5—5 of FIG. 4.

FIGS. 3–9 illustrate a TIJ pen 50 embodying the invention. The pen includes an external pen case structure comprising frame structure 60 and a pair of side covers 70 and 80. The frame structure 60 defines a closed band, i.e., a closed frame loop, and first and second opposed side open areas 64, 66 on either side of the band or loop. A pen snout region 75 is defined at one corner of the pen 50, and a TIJ printhead is secured at the end 77 of the snout region 75 (FIG. 5). TIJ printheads are well known in the art, and include a plurality of print nozzles disposed in a printhead plane. In this exemplary embodiment, the nozzles eject ink droplets in a direction generally orthogonal to the printhead plane. For purposes of defining the orientation of the pen, the "vertical" direction is considered to be the direction normal to the nozzle plane. The pen 50 and carriage 38 are also provided with electrical wiring elements (not shown) to connect the printhead 76 to the printer controller to control the operation of the printhead, as is well known in the art.

In this exemplary embodiment, the pens 50 are secured in the carriage 38 such that the longest pen dimension, the height dimension, extends generally along a vertical direction, with the print medium disposed below the pen printheads in a generally horizontal position. While such a configuration minimizes the pen footprint, the invention is not limited to such a "vertical" orientation of the pen. The pen may also be disposed, for example, such that the longest pen dimension extends along the horizontal, and the print medium is disposed along the vertical in the printing area.

The pen 50 includes a simple and efficient ink delivery system, more fully described in the above-reference pending applications, Ser. Nos. 07/928,811 and 07/929,615. Generally, ink is contained within a reservoir 62 formed by two pieces 64 and 66 of thin polyethylene bag material bonded to an inner frame element 68 fabricated of a compatible plastic material secured to the external frame element 78. Two piston plates 72A and 72B and a spring 74 inside the reservoir 62 provide backpressure, i.e., negative pressure, to prevent ink from drooling out the nozzles of the TIJ printhead 52.

The frame structure 60 includes two elements 68 and 78, made of two different plastic materials. Element 78 is an external frame element, fabricated of a first material, preferably an engineering plastic forming the external surfaces and providing structural support. An exemplary plastic suitable for the purpose is polyphenyleneoxide (PPO). The element 68 is an interior frame element, fabricated of a second plastic material, which provides the fluid path for the ink and is suitable for attachment of the bag membranes 64 and 66, as described more fully in the above-referenced pending application Ser. No. 07/853,372. An exemplary plastic suitable for the second plastic material is a polyolefin alloy or a glass-filled polyethylene. A preferred material for the membranes 64 and 66 is ethylene-vinyl acetate (EVA).

A pair of elements 90 and 92 are disposed in the fluid path between the reservoir 62 and the ink chamber 94 for the printhead 76. Elements 90 and 92 are fine mesh screens which serve as air bubble check valves and particulate filters, preventing air bubbles from entering the reservoir from the printhead nozzles, thereby reducing the negative pressure of the spring bag. The elements 90 and 92 also prevent particles from passing from the reservoir to the printhead and clogging the printhead nozzles. The elements 90 and 92 are more fully described in the referenced patent application entitled "Combined Filter/Air Check Valve for Thermal Ink-Jet Printer."

While the ink reservoir comprises a negative pressure spring bag reservoir in the preferred embodiment, the reservoir need not employ this particular spring bag embodiment. Accordingly, the invention is not limited to the particular ink delivery system employed by the pen.

The covers 70 and 80 may be fabricated of any suitable material; in this exemplary embodiment, the covers are fabricated of metal. The thin metal side covers 70 and 80 protect the inside components, add considerable rigidity to the system, and allow for a high degree of volumetric efficiency. The covers 70 and 80 can be fabricated of a preprocessed metal, such as metal having a pre-painted surface or a PVC clad metal to provide an aesthetically complete appearance. The covers 70 and 80 must be very rigid to prevent ink from being squeezed out in the event force is applied against the covers, e.g., during handling of the pen. An exemplary material from which the covers 70 and 80 may be fabricated is low carbon steel having a thickness of 0.019 inches.

The metal covers 70 and 80 may be attached to the plastic frame 60 by adhesives or screw fasteners, or by use of thermal or ultrasonic processes. However, as described in the co-pending application referenced above and entitled "Thermal Ink-Jet Pen with a Plastic/Metal Attachment for the Cover", the problem of attaching a cover to a thin plastic frame is solved by designing a series of metal tabs 82 and 84 on the covers 70 and 80 that will lock onto mating plastic features on the frame 60, e.g. slot 86 (FIG. 4). The tabs displace plastic on the mating features of the frame during assembly, allowing use of a simple mechanical press to assemble the cover to the frame, with no adhesives, screws, thermal or ultrasonic processes. The design of the cover tabs also enables them to lock into the frame; and the addition of chamfered corners on the tab aids assembly by providing a lead-in surface. The resulting cover/frame seam will resist shear, axial and transverse forces that occur in the joint as a result of externally applied loads to the pen. This joint allows for use of cosmetically suitable cover materials (e.g., pre-painted metal, PVC clad metal, or metals having a suitable cosmetic surface).

FIGS. 6A–6C show respective side, front, and top views of the pen 50. These views illustrate the respective proportions of the width W, height H and depth D of the body of the pen. According to one aspect of the invention, in order to provide a narrow pen while at the same time providing a pen having substantial ink reservoir capacity, the height and depth dimensions are selected to be at least twice the width dimension. In an exemplary embodiment, the dimension W is 18.8 mm (0.73 inches), the dimension D is 60 mm (2.37 inches), and the dimension H is 78 mm (3.07 inches). Such a relatively high and narrow pen body permits the required carriage travel along the scan axis to be substantially reduced over previous pen designs, while at the same time providing substantial body volume which generally equals if not exceeds that of available ink reservoir in such previous designs. The pen snout region 75 has a width equal to the width W of the pen body.

It will be seen from FIGS. 1 and 2 that the pen 50 is designed such that the narrow dimension W of the pen 50 is aligned with the scan axis 44 along which the pen is driven with the carriage 38. It is this narrowness of the width W of the pen 50 which results in a reduction of the width of the carriage 38 and the consequent reduction in the width of the printer housing 32. The dimensions H and D (FIG. 6) are measured along axes which extend orthogonally to the axis 44 with which the narrow dimension W is measured. The carriage 38 positions the pen snout region 75 and the printhead 76 above and spaced from the upper surface of the print medium 36.

An exemplary embodiment of the pen 50 can be fabricated to have an ink capacity of 42.5 cc, with a pen width of about 19 mm. This capacity versus width ratio (42.5 cc/19 mm=2.24 cc/mm) may be compared with other ink cartridges on the market today. For example, the HP 51608A cartridge has a width dimension along the carriage axis of 31 mm, and an ink capacity of 19 cc (0.61 cc/mm). The HP 51606A cartridge has a similar width dimension of 28 mm, with an ink capacity of 12 cc (0.43 cc/mm). The invention presents a clear advantage of ink capacity for a given carriage travel distance, thereby minimizing the required width of the printer.

FIG. 7 illustrates the rigid open loop formed by the exterior frame element 78. Taken along line 7—7 of FIG. 3, and omitting the internal ink reservoir bag and spring elements for clarity, the cross-sectional view of FIG. 7 shows the open area generally circumscribed by the loop.

FIGS. 8 and 9 are orthogonal cross-sectional views taken along lines 8—8 and 9—9 of FIG. 7, also omitting the internal ink reservoir bag and spring elements for clarity. These views indicate the attachment of the covers 70 and 80 to the frame 60 by use of the tabs 82 and 84 pressed into engagement with recessed features such as feature 86 (FIG. 4) formed into the external plastic frame element 78. As shown in these views, the tabs attach to the frame element 78 on all sides of the frame element.

According to another aspect of this invention, the covers 70 and 80 are made of a material which is stronger than the material from which the frame element 78 is made. Thus, the frame element 78 is formed of a first material characterized by a first strength modulus value, and the covers 70 and 80 are formed of a second material characterized by a second strength modulus value, wherein the second strength modulus value-is greater than the first value. As a result, the elements 70, 78 and 80 define a rigid external case structure for a TIJ pen which resists without substantial deformation compression forces applied normally to the plane of the covers, and as well forces applied to the case structure generally normal to the element 78 and parallel to the covers 70 and 80. Thus, the rigidity of the external case structure prevents, for example, the covers from being deflected inwardly in response to typical compression forces likely to be experienced by the case structure in normal storage or handling, to reduce the volume available for the ink reservoir supply. Such deflection could well cause ink to drool out of the printhead nozzles.

By way of example, the engineering plastic marketed under the trademark "NORYL GFN2" (20% glass-filled NORYL) by the General Electric Company, used in the preferred embodiment to fabricate frame element 78, has a Tensile modulus value on the order of $9.25\times10^5$ psi. A preferred material from which the covers may be fabricated is mild steel, which has a Young's modulus value on the order of 25,000 to 33,000 Kpsi. A plastic material, marketed by E. I. de Nemours DuPont Company under the commercial trade name "Kapton," could alternatively be used to fabricate the covers, and has a Young's modulus value on the order of 10,000 psi.

By using a cover material which is stronger than the material of the frame element 78, thin covers can be used to span the open area 110 without the need for additional cover support structure such as connecting webs or ribs extending into the interior of the area 110 and spanning the distance between the opposing covers 70 and 80. Such support structure could well be necessary to prevent deflection of thin covers made of a material of similar or weaker strength compared to the frame 78, but would provide the disadvantages of reducing the volume within the case structure which is available to the ink reservoir, complicating the design of the spring and bag elements, and driving up the cost of the pen. Of course, the use of a weaker material to fabricate thick covers to provide the strength necessary to prevent deflection in response to deflection forces would result in increasing the width dimension W of the pen, thereby increasing the carriage and printer width. Metal covers can be made much thinner, as much as five times thinner, than plastic covers can be injection molded. It is possible to use a thin plastic (in sheet form) as the cover, and weld a seam around the edge of the rigid loop frame structure. In this case, the thin plastic cover material is stronger than the frame 78 material.

FIGS. 10 and 11 show the benefit of a reduced width pen structure in accordance with the invention, in reducing the required width of the printer. FIG. 10 shows the carriage 38 situated at the extreme left position of its scanning along axis 44. FIG. 11 shows the carriage 38 situated at its extreme right position. The total travel of the carriage to permit each pen printhead access to the full width of the print medium 36 is indicated as S, and is about equal to the width P of the medium 36 plus twice the width of the carriage 38. If the pen width W is, say 0.75 inches, and the pen mounts of the carriage require 0.25 inches per pen, the total carriage width can be made to be 4.0 inches. This can be contrasted with the conventional pen having a width of at least 1.25 inches and a required carriage width of at least 6.8 inches.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. In a pen cartridge including an ink reservoir and a printhead, a pen case structure comprising:

an external pen frame structure fabricated of a first material, said frame structure defining a peripheral wall structure having opposed wall edges and first and second opposed side open regions within said opposed edges;

first and second thin cover members made of a second material attached to said frame structure for covering said open regions of said frame structure, each of said cover members comprising a planar member fabricated of a thin metal sheet;

said ink reservoir contained within said case structure in fluid communication with said printhead;

wherein said pen case structure upon attachment of said cover members to said frame structure is rigidified so as to be substantially non-compressible in response to forces exerted against said side members or against said frame structure.

2. The pen case structure of claim 1 wherein said metal sheet has a thickness of 0.025 inches or less.

3. The pen case structure of claim 2 wherein said metal sheet is fabricated from a mild steel.

4. The pen case structure of claim 1 wherein said first material comprises a plastic material.

5. The pen case structure of claim 1 wherein said peripheral wall structure defines a substantially closed frame loop.

6. The pen case structure of claim 1 wherein said cover members are attached to said frame structure at points along said wall edges, thereby adding to the rigidity of said pen case structure.

7. The pen case structure of claim 1 wherein said printhead is a thermal ink-jet printhead.

8. In a pen cartridge including an ink reservoir and a printhead, a rigid external case structure comprising:

an external pen frame structure fabricated of a first material characterized by a first strength modulus value, said frame structure defining a substantially closed frame loop and first and second opposed side open regions on either side of said loop;

first and second thin cover members fabricated of a second material characterized by a second strength modulus value, said second value higher than said first value, said cover members attached to said frame structure for covering said open regions of said frame structure, each of said cover members comprising a planar member fabricated of a thin metal sheet, said ink reservoir contained within said case structure in fluid communication with said printhead;

wherein said case structure upon attachment of said cover members to said frame structure is rigidified so as to be substantially non-compressible in response to forces exerted against said side members or against said frame structure.

9. The case structure of claim 4 wherein said metal sheet has a thickness of 0.025 inches or less.

10. The case structure of claim 9 wherein said metal sheet is fabricated from a mild steel.

11. The case structure of claim 8 wherein said cover members are attached to said frame structure at points along said wall edges, thereby adding to the rigidity of said pen case structure.

12. The case structure of claim 8 wherein said first material is a plastic, and said second material is a metal.

13. A printer for printing on a print medium, comprising:

a printer housing;

a pen carriage supported by said housing for travel along a carriage axis adjacent said print medium, said carriage comprising means for holding an ink cartridge pen;

said pen comprising:

an external pen frame structure fabricated of a first material, said frame structure defining a peripheral wall structure having opposed wall edges and first and second opposed side open regions within said opposed edges;

first and second thin cover members made of a second material attached to said frame structure for covering said open regions, said cover members each comprising a planar member fabricated of a thin metal sheet;

a printhead supported by said frame structure;

an ink reservoir in fluid communication with said printhead;

wherein said pen frame structure and said cover members comprise a pen case structure which upon attachment of said cover members to said frame structure is rigidified so as to be substantially non-compressive in response to forces exerted against said cover members or against said frame structure, and said ink reservoir is disposed within said case structure.

14. The printer of claim 13 wherein said carriage comprises means for holding a plurality of said ink cartridge pens.

15. The printer of claim 13 wherein said metal sheet has a thickness of 0.025 inches or less.

16. The printer of claim 15 wherein said metal sheet is fabricated from a mild steel.

17. The printer of claim 13 wherein said first material is a plastic material.

18. The printer of claim 17 wherein said plastic material is a rigid plastic.

19. The printer of claim 13 wherein said peripheral wall structure defines a substantially closed frame loop.

* * * * *